US011225104B2

(12) United States Patent
Hepinstall

(10) Patent No.: US 11,225,104 B2
(45) Date of Patent: Jan. 18, 2022

(54) PAINTBRUSH HOLDER

(71) Applicant: Ray Hepinstall, Simi Valley, CA (US)

(72) Inventor: Ray Hepinstall, Simi Valley, CA (US)

( * ) Notice: Subject to any disclaimer, the term of this patent is extended or adjusted under 35 U.S.C. 154(b) by 0 days.

(21) Appl. No.: 16/537,622

(22) Filed: Aug. 11, 2019

(65) Prior Publication Data

US 2020/0047544 A1 Feb. 13, 2020

Related U.S. Application Data

(60) Provisional application No. 62/718,100, filed on Aug. 13, 2018.

(51) Int. Cl.
*B44D 3/12* (2006.01)

(52) U.S. Cl.
CPC ..... *B44D 3/123* (2013.01)

(58) Field of Classification Search
CPC .. B44D 3/123; B44D 3/12; A47K 1/09; A46B 17/02; A46B 17/00; A46B 17/08; A47B 81/02
USPC ..... 248/110, 113
See application file for complete search history.

(56) References Cited

U.S. PATENT DOCUMENTS 552,921 A * 1/1896 Miner ..... A47L 13/512 248/113
1,703,008 A * 2/1929 Justice ..... B44D 3/123 248/113
2,466,661 A * 4/1949 Massey ..... B44D 3/12 15/257.01
3,603,551 A * 9/1971 Peterson ..... A47F 7/0028 248/314
D622,469 S * 8/2010 Nacey ..... D32/54
D757,383 S * 5/2016 Abbott ..... D32/54
2005/0145757 A1* 7/2005 Brown ..... A46B 17/02 248/110
2009/0235443 A1* 9/2009 Arora ..... C11D 17/0056 4/231
2012/0193358 A1* 8/2012 Billado, Jr. ..... B65D 43/02 220/212
2018/0215196 A1* 8/2018 Stapleton ..... B44D 3/127
2019/0344608 A1* 11/2019 Baker ..... A46B 17/02

* cited by examiner

*Primary Examiner* — Don M Anderson
(74) *Attorney, Agent, or Firm* — Christopher Mayle; Bold IP, PLLC

(57) ABSTRACT

A device for holding a paintbrush from a lip or edge of a paint container such that the paintbrush bristles are allowed to be submerged at a controllable depth in the paint of the paint container.

3 Claims, 5 Drawing Sheets

PAINTBRUSH HOLDER

CROSS-REFERENCE TO RELATED APPLICATIONS

This application is a non-provisional patent application which claims priority to U.S. Provisional Application No. 62/718,100 filed on Aug. 13, 2018, which is incorporated by reference in its entirety.

FIELD OF THE DISCLOSURE

The present invention relates generally to accessories for painting. More specifically, the present invention relates to a portable paintbrush holder which is detachably mounted around the handle of a paint brush.

BACKGROUND

Traditionally, when a painter desires to no longer grasp a paint brush, the painter must lay the wet paint brush on its side across the top of a paint container such that a handle of the paint brush comes into contact with one side of the lip of the paint where the lid provides structural support. In this orientation the bristles usually come in contact with the opposing side of the lip of the paint container. This positioning of the paint brush in this arrangement also causes the lip of the paint container to coat the handle of the paint brush and exposes the bristles of the paint brush to other objects or individuals moving around, near, or otherwise in proximity to the resting paint brush. Additionally, the bristles of the paintbrush would be exposed to the air in this position and the paint may undesirably dry on the bristles. Alternatively, a painter may rest a paintbrush in a tray or similar apparatus. This positioning may also expose the bristles of the paintbrush to the air and undesirably dry the paint on the bristles and the additional apparatuses occupy valuable space and may be cumbersome to transport.

To prevent paint from drying to the bristles of a paintbrush, a painter may place the paintbrush with the bristles orientated directly into the paint in a paint container. However, when the painter retrieves the submerged paintbrush, the bristles may be completely saturated and paint may have intruded the ferrule. Fully saturated bristles and a ferrule intruded with paint would be undesirable as that would represent an excess of paint on the brush which would likely prevent adequate cleaning of paint from the paintbrush. Furthermore, without adequate cleaning, a paintbrush would be contaminated with the most recently used paint. Additionally, saturated bristles would reduce or prevent optimum control of paint applied to a surface. Thus, it would be desirable for a painter to rest a wet paintbrush such that a desired section of the bristles of the paintbrush may be submerged in paint within a paint container.

SUMMARY

The disclosure presented herein relates to one or more paint brush holders configured for detachable installment on and over the upper rim of a paint container, the paint brush holder comprising a ring configured to slide over a handle of a paintbrush and an arm connected to the ring, wherein when the ring has been slid over the handle of the paint brush, the arm and paintbrush configured together function as an anchor to hold onto the upper rim of the paint container, wherein the arm is made of a rigid material, wherein the arm projects at a downward angle from the ring, the arm comprised of an elongated component, the ring comprised of a strip implement, the implement at a lower elevation than a top surface of the ring, the implement at a higher elevation than the bottom surface of the ring.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
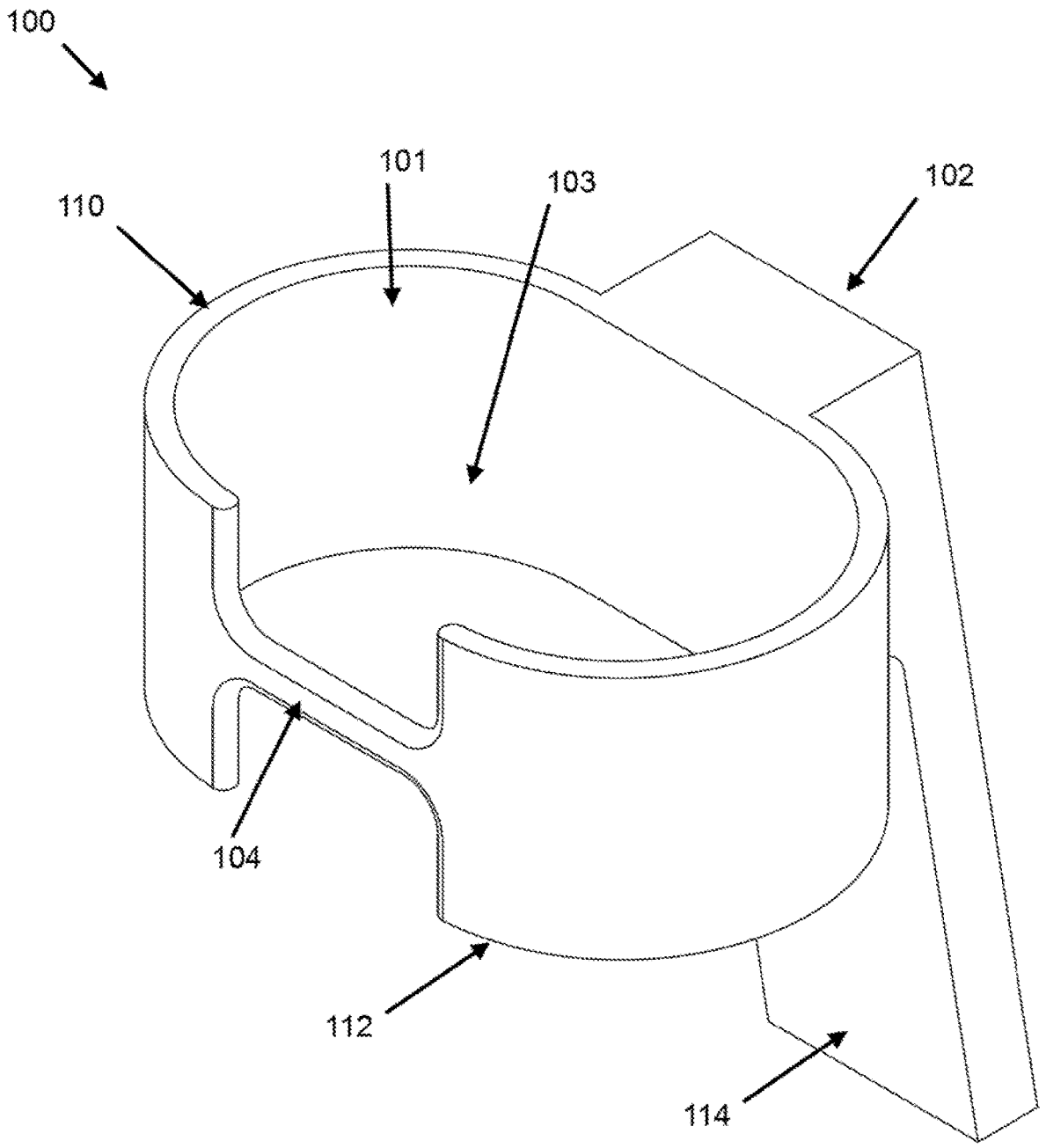
FIG. 1 is a perspective view of the paintbrush holder

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises", and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and the upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present invention recognizes the unsolved need for an improved system and method that attaches to the lip of a paint container while holding a paint brush at a predetermined depth in a paint container such that the bristles of the paintbrush may be submerged in paint within a paint container wherein the bristles will not be completely saturated and paint may have intruded the ferrule.

With reference now to FIG. 1, one exemplary embodiment of paint brush holder system 100 according to the present invention is generally designated. Paint brush holder system 100 may include a ring such as ring 101 to slide over a handle of a paintbrush. Ring 101 may be elliptical in shape; however, this is non-limiting and may be circular, square, rectangular, octagonal, hexagonal, or any other shape that is capable of allowing a paint brush to pass through and secure said paint brush. In other non-limiting embodiments there may be multiple paint brush holders capable of holding a paintbrush arranged around the perimeter of the upper rim of a paint bucket.

Ring 101 may include an implement such as implement 104. Ring 101 may be in the form of a discorectangle or stadium and made of an implement 104 and an arc portion such that implement 104 joins two points on the arc portion of ring 101 whereby the chord of a discorectangle or circle is a straight line segment whose endpoints both lie on a circular arc, wherein implement 104 be positioned at a lower elevation than a top surface such as top surface 110 of ring 101 and a higher elevation than a bottom surface such as bottom surface 112 of ring 101 to facilitate additional flexibility of ring 101 when slid over the handle of a paintbrush. Ring 101 and implement 104 may be fashioned from an elastic material wherein implement 104 facilitates stretching of ring 101 to accommodate variably sized paintbrush handles. Additionally, implement 104 allows a user to adjust the position of ring 101 when slid over a handle of a paintbrush such that a user can control the depth to which the bristles are submerged in a paint container.

Figure 2:
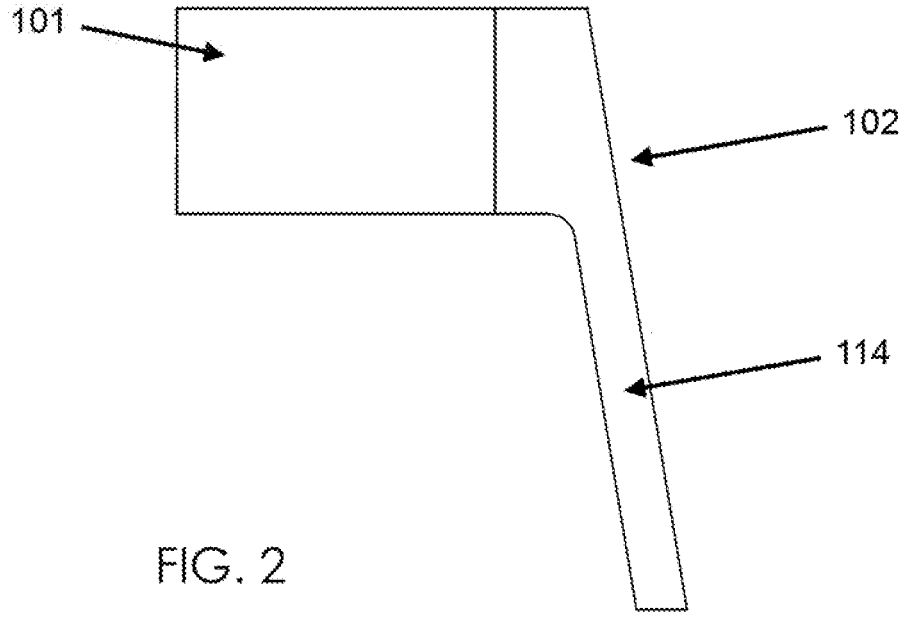
FIG. 2 is a side view of the paintbrush holder.
Figure 3:
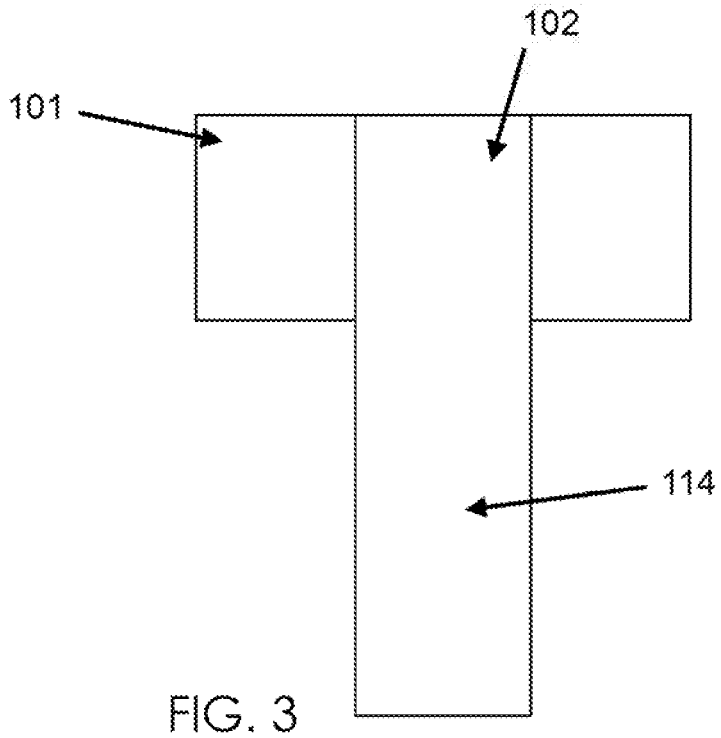
FIG. 3 is a rear view of the paintbrush holder.

As illustrated in FIG. 2 and FIG. 3, a side view and rear view of paint brush holder system 100 shows ring 101 attached to an arm such as arm 102. Arm 102 may be rigid and project at a downward angle from ring 101. Arm 102 may have a handle like shape with an elongated component such as elongated component 114. When a paintbrush handle is situated within ring 101, the paint brush handle and the elongated component 114 together function as an anchor to hold onto a lip or edge of a paint container. Elongated component 114 may be of any length and specifically tailored to provide a proper anchoring balance support to the paint brush handle and sized to fit any paint container.

Figure 4:
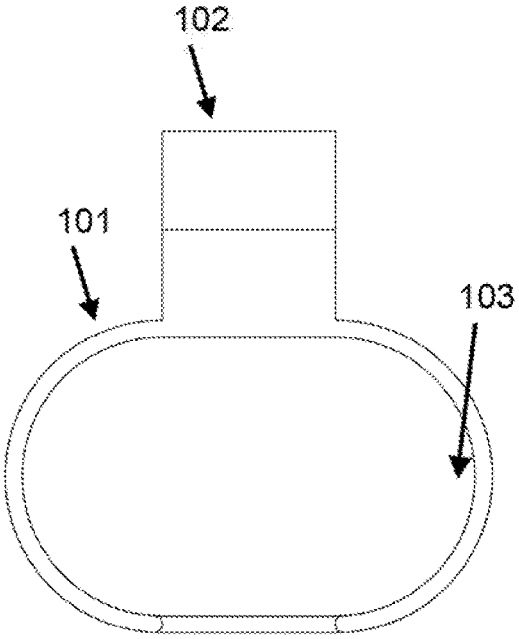
FIG. 4 is a top view of the paintbrush holder.
Figure 5:
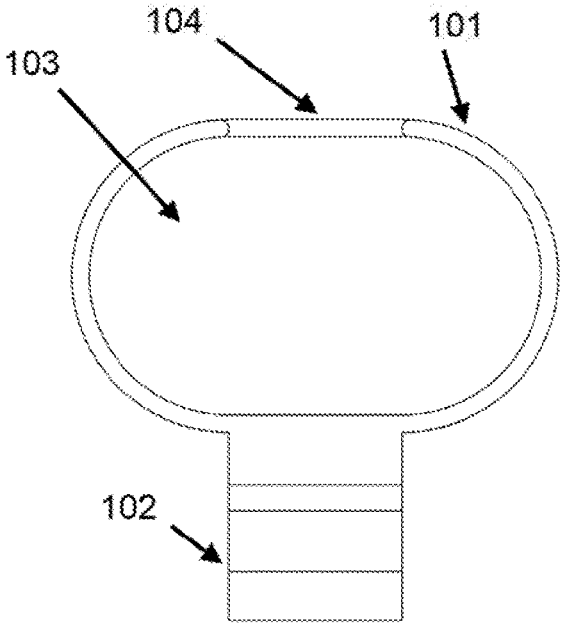
FIG. 5 is a bottom view of the paintbrush holder.

As illustrated in FIG. 4 and FIG. 5, ring 101 may be substantially elliptical with an opening such as opening 103 wherein ring 101 may be slid over the handle of a paintbrush and contact a substantial periphery of the paint brush handle.

Figure 6:
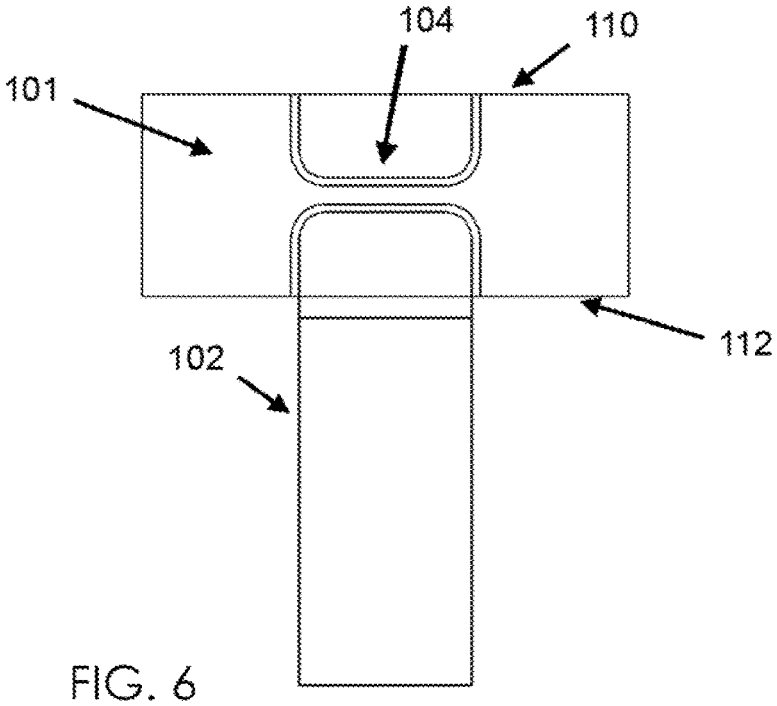
FIG. 6 is a front view of the paintbrush holder.
Figure 7:
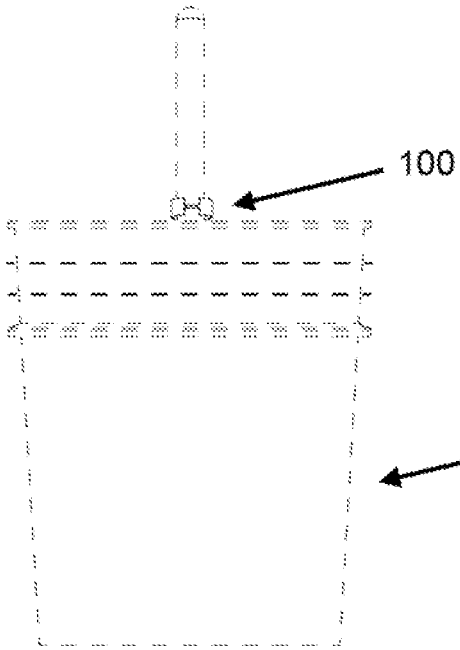
FIG. 7 is a front view of the paintbrush holder in use with a paintbrush and paint container.
Figure 8:
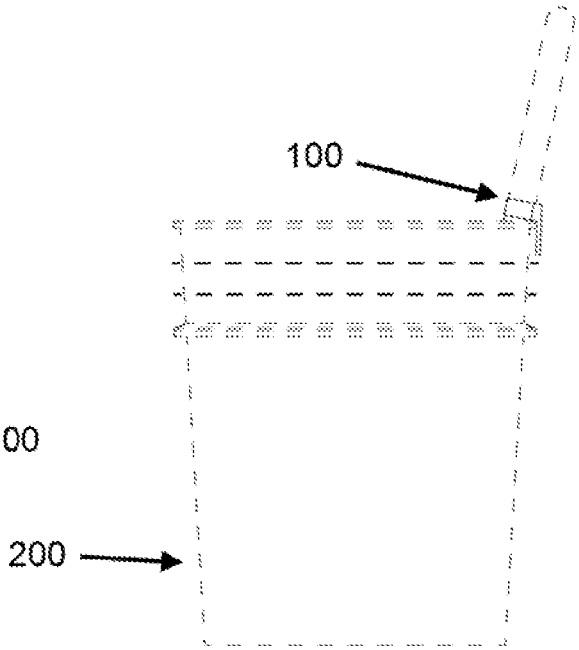
FIG. 8 is a side view of the paintbrush holder in use with a paintbrush and paint container.
Figure 9:
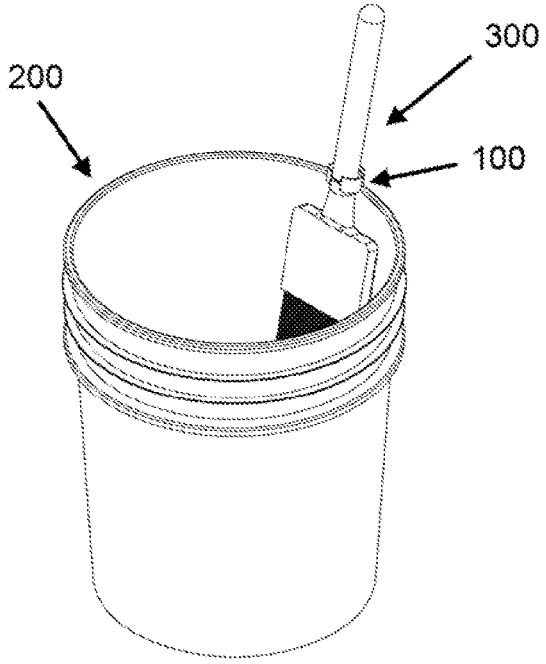
FIG. 9 is a top perspective view of the paintbrush holder in use with a paintbrush and paint container.
Figure 10:
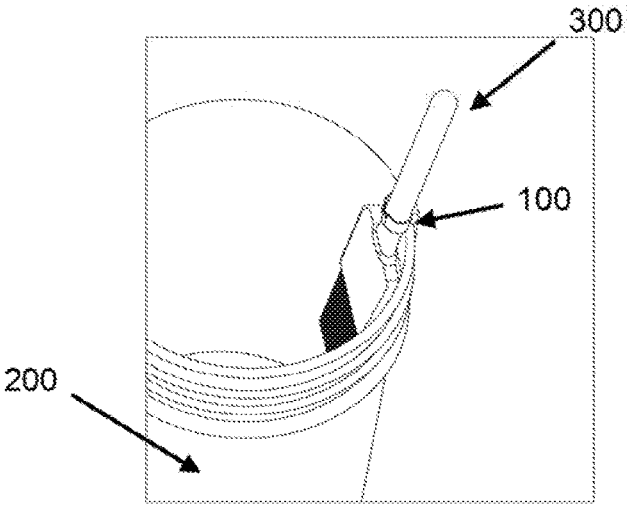
FIG. 10 is a top perspective view of the paintbrush holder in use with a paintbrush and paint container.

As illustrated in FIG. 6, implement 104 may be located within ring 101 wherein implement 104 is a horizontal elongated strip of less height and area than the adjacent portions of ring 101 such that implement 104 is of a lower elevation than top surface 110 of ring 101 and a higher elevation than bottom surface 112 of ring 101. Implement 104 forms two mirror U-shaped openings in ring 101. Implement 104 may be fashioned from elastic material such that ring 101 may stretch over a handle of a paintbrush and, once situated on the handle, compress the ring 101 into a secure position on the paint brush handle. Alternatively, in one or more non-limiting embodiments, implement 104 and ring 101 may be fashioned from elastic material to similarly stretch over the handle of a paintbrush and compress into a secure position on the paint brush handle. The different implementation in the elasticity of ring 101 and implement 104 are useful for different shaped handles, the longevity of paint brush holding system 100, and the needs of a cheaper price during the manufacturing process.

As shown in FIG. 7-FIG. 10, a paint brush such as paint brush 300 may be captured and retained by ring 101 and implement 104 when paint brush 300 is slid into ring 101. Ring 101 and/or implement 104 may be stretched to a specific size to accommodate paint brush 300. After such an installation, paint brush holding system 100 may be installed over the side of a paint container such as paint container 200, wherein arm 102 comes into contact with paint container 200 and elongated component 114 comes into contact with the exterior of paint container 200. Paint brush 300 and arm 102 effectively embrace paint container 200 and hold paint brush 300 at the desired depth within paint container 200.

In this manner, the brush bristles of paint brush 300 may be suspended at a desired point within the liquid paint in paint container 200 so that only the tips of the bristles or desired length of bristles is wetted. This keeps the brush fresh for continued use and preventing the paint from drying in the bristles while not allowing for over saturation. The depth of paint brush 300 may be readjusted by stretching ring 101 and/or implement 104 and placing stretched ring 104 and/or implement 104 over paint brush 300 at the desired point.

In some embodiments there may be multiple rings wherein rings may be slid over the handles of multiple paintbrushes and contact a substantial periphery of the multiple paint brush handle.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A paint brush holder for installment on and over an upper rim of a paint container, the paint brush holder comprising:

a holding element that is discorectangle in shape; and an arm connected to the holding element, the holding element having an arc portion and an implement;

wherein the arc portion is comprised of a first straight side length connected to two semicircles at a first end of each of the two semicircles, wherein the implement is a second straight side length connected to a second end of each of the two semicircles, wherein the implement is elastic and permits a user to adjust a position of a paintbrush in relation to the holding element to control a depth to which bristles of the paintbrush are submerged in the paint container, wherein the implement is at a lower elevation than a top surface of the holding element, wherein the implement is at a higher elevation than a bottom surface of the holding element, and the implement is comprised of an elastic material.

2. The paint brush holder of claim 1, wherein the arm is made of a rigid material.

3. The paint brush holder of claim 1, wherein the arm projects at an outward extending downward angle from the ring.

* * * * *